US005927053A

United States Patent [19]

Donovan et al.

[11] Patent Number: 5,927,053

[45] Date of Patent: Jul. 27, 1999

[54] CASE LOADER AND METHOD OF LOADING

[75] Inventors: Richard P. Donovan, New Richmond, Wis.; Edward R. Butterly, Jr., Brookfield, Conn.; Kai E. Hansen, Tunkhannock, Pa.

[73] Assignee: Cannon Equipment Company, Rosemount, Minn.

[21] Appl. No.: 08/882,851

[22] Filed: Jun. 26, 1997

Related U.S. Application Data

[ 60] Provisional application No. 60/020,667, Jun. 28, 1996.

[51] Int. Cl.[6] ..... B65B 35/30

[52] U.S. Cl. ..... 53/543; 53/168; 53/201; 53/202; 53/247; 53/251

[58] Field of Search ..... 53/202, 201, 246, 53/247, 250, 251, 448, 439, 543, 168

[56] References Cited

U.S. PATENT DOCUMENTS

| | | | |
|---|---|---|---|
| 3,209,923 | 10/1965 | Bargel et al. | 53/539 X |
| 3,225,891 | 12/1965 | Hickin et al. | 53/251 X |
| 3,290,859 | 12/1966 | Talbot | 53/534 |
| 3,479,795 | 11/1969 | Martin | 53/537 X |
| 3,513,623 | 5/1970 | Pearson | 53/168 X |
| 3,948,018 | 4/1976 | Rowekamp | 53/202 X |
| 4,063,185 | 12/1977 | Goff | 53/543 X |
| 4,211,056 | 7/1980 | Birk | 53/543 |
| 4,259,826 | 4/1981 | Campbell | 53/543 |
| 4,473,987 | 10/1984 | Wild | 53/202 X |
| 4,843,797 | 7/1989 | Butterly et al. | 53/539 X |
| 4,977,727 | 12/1990 | Milleson | 53/543 |
| 5,060,455 | 10/1991 | Schmeisser | 53/448 |

*Primary Examiner*—Daniel B. Moon
*Attorney, Agent, or Firm*—Sten Erik Hakanson

[57] ABSTRACT

The present invention concerns a caser for quickly organizing variously sized containers into a plurality of predetermined patterns and then simultaneously filling an equal plurality of individual cases with that predetermined number of products. The caser of the present invention includes two parallel in-feed conveyors each delivering a single file continuous stream of containers to a loading area. Clamp and sensor means provide for regulating a predetermined number of containers into a pattern forming area from each conveyor. After a pattern is formed by an alternating pusher means that provides for pushing the group of containers either right or left to a position over one of two loading areas. Each loading area includes trap door means and a gripper head assembly. Each gripper head assembly includes a plurality of gripper heads each for gripping one of the plurality of patterns of containers. The gripper heads provide for gripping the containers and lowering them into cases after the trap door means open. The cases are delivered by third and fourth conveyors to positions directly below each of the trap door means. To account for the width of the sidewalls of each case, the gripper heads are movable horizontally so that each pattern is centered over the interior of its respective case prior to the lowering thereof. Thus, multiple cases can be filled at the same time by a single lowering movement of each gripper head assembly. During a loading process a further plurality of patterns is being formed and moved by the pusher to the other loading area.

6 Claims, 12 Drawing Sheets

10
L
R
56
17
18
56
54a
54b
32
28
38
31
24
45
24
36
22
45
34
12
28
32
32
54a
54b
56
56
G
16b
16a
14b
14a

10

12
22
20
G
G
14a
16a
12
62
62
62
C
64

4
12
24
32
42
41
48
S
26
27

GALLON INFEED

QUART INFEED

HALF GALLON INFEED

CASE LOADER AND METHOD OF LOADING

This application claims the benefit of U.S. Provisional Application No. 60/020,667, filed Jun. 28, 1996.

BACKGROUND OF THE INVENTION

1. Field of the Invention

The present invention relates generally to case loading equipment, and in particular to automated equipment for loading dairy products into cases.

2. Background

Grocery products such as milk and orange juice come in a variety of sized containers. Such containers are both filled at bottling plants and then loaded into cases for shipment to food retailers. Casing equipment has generally had to keep up with the speed with which the bottling equipment can fill the various containers to optimize the through-put ability of the bottling facility. A significant increase in casing speed was seen with the equipment described in U.S. Pat. No. 4,843,797. In this device, dual in-feed conveyors were used along with assembly areas to provide for functional overlap so as to allow for an increased casing rate of around 100 one gallon bottles per minute. However, substantial increases in that bottling rate will need to be accommodated and therefore, it will be necessary to have casing equipment equal to the task.

SUMMARY OF THE INVENTION

The present invention concerns a caser for quickly organizing variously sized containers into a plurality of predetermined patterns and then simultaneously filling an equal plurality of individual cases with that predetermined number of products.

The caser of the present invention includes two parallel in-feed conveyors each delivering a single file continuous stream of containers to a loading area. Clamp and sensor means provide for regulating a predetermined number of containers into a pattern forming area from each conveyor. After a pattern is formed by an alternating pusher means that provides for pushing the group of containers either right or left to a position over one of two loading areas. Each loading area includes trap door means and a gripper head assembly. Each gripper head assembly includes a plurality of gripper heads each for gripping one of the plurality of patterns of containers. The gripper heads provide for gripping the containers and lowering them into cases after the trap door means open. The cases are delivered by third and fourth conveyors to positions directly below each of the trap door means. To account for the width of the sidewalls of each case, the gripper heads are movable horizontally so that each pattern is centered over the interior of its respective case prior to the lowering thereof. Thus, multiple cases can be filled at the same time by a single lowering movement of each gripper head assembly. During a loading process a further plurality of patterns is being formed and moved by the pusher to the other loading area.

It can be appreciated that the present invention provides for an increasing through-put by forming patterns directly as the result of the conjoining of two infeed lines, the overlap of functions wherein while one group of containers are being loaded into cases another group is being formed and moved into position for loading, and by being able to fill multiple cases simultaneously.

DESCRIPTION OF THE DRAWINGS

A further understanding of the structure, function, operation, and advantages of the present invention can be had by referring to the following detailed description which refers to the following figures, wherein.

DETAILED DESCRIPTION OF THE INVENTION

Figure 1:
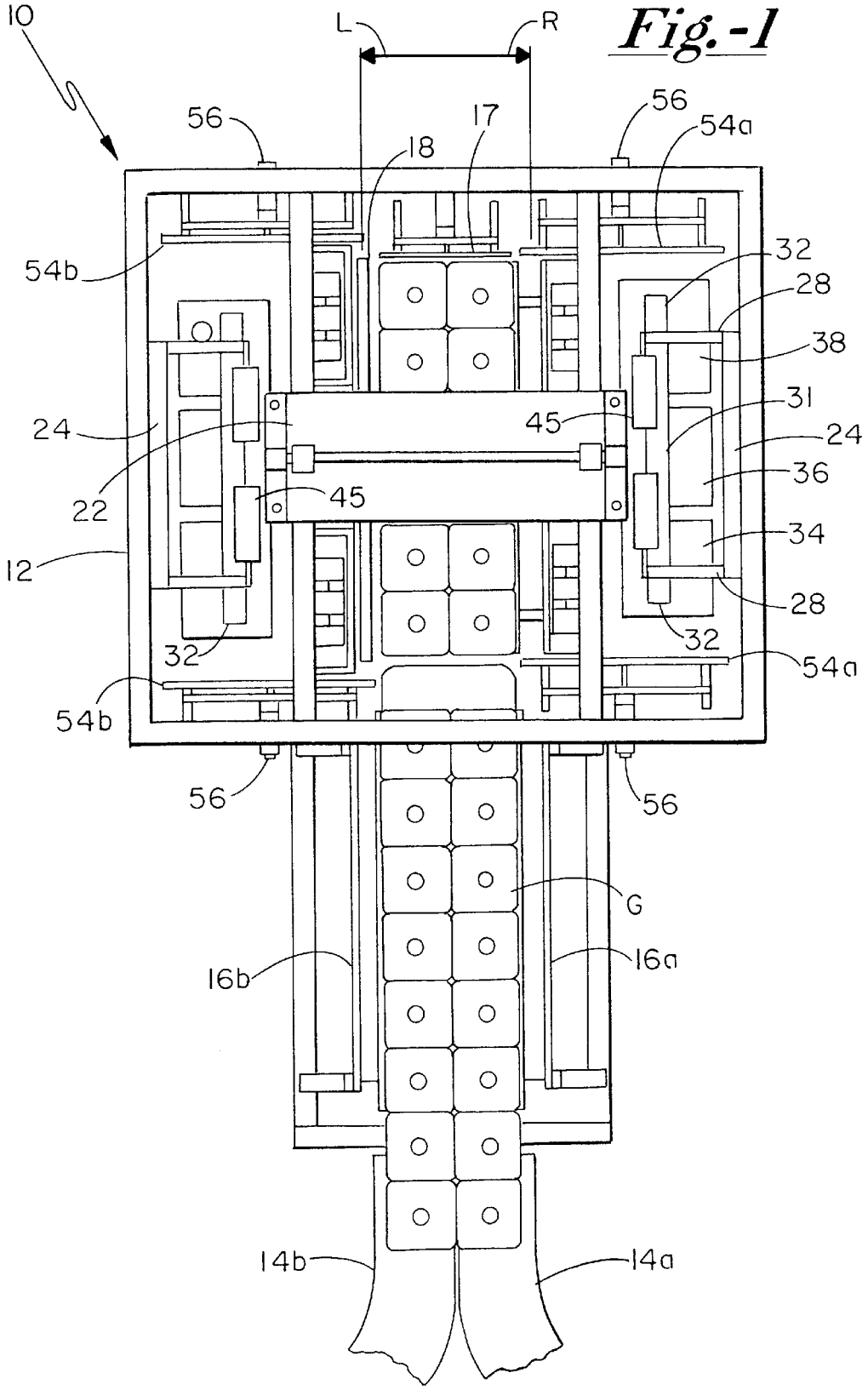
FIG. 1 shows a top plan view of the present invention.
Figure 2:
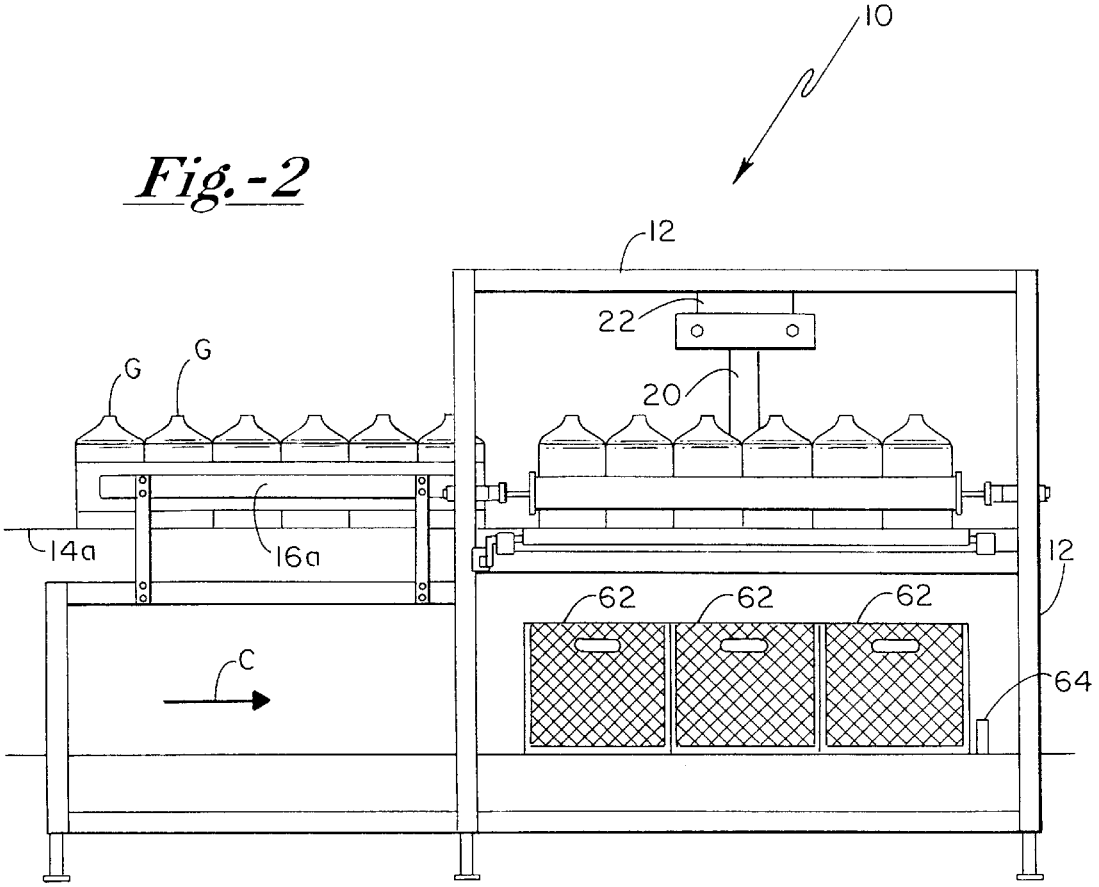
FIG. 2 shows a side plan view of the present invention along lines 2—2 of FIG. 1.
Figure 3:
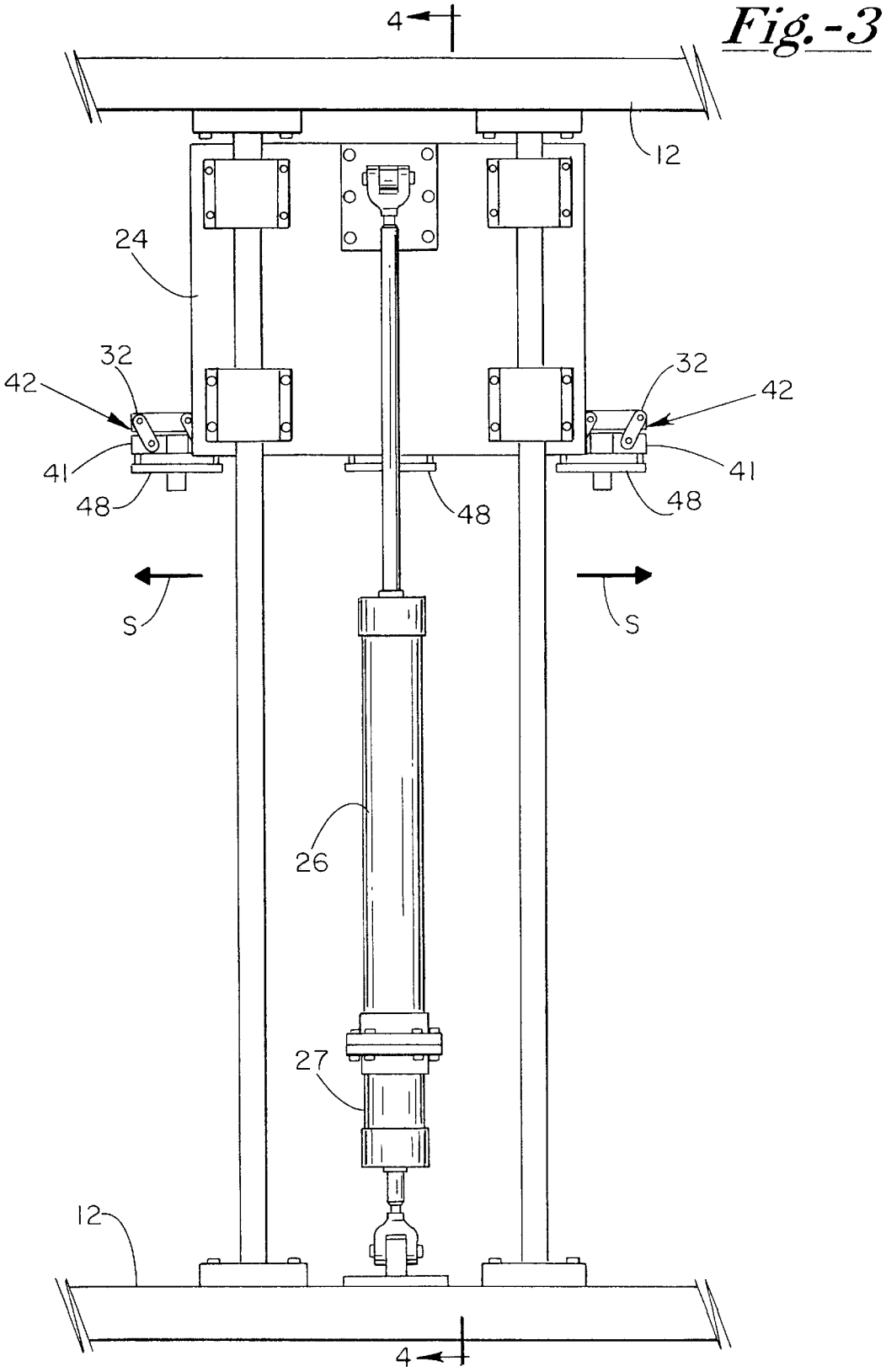
FIG. 3 shows a side plan view along lines 3—3 of FIG. 1.
Figure 4:
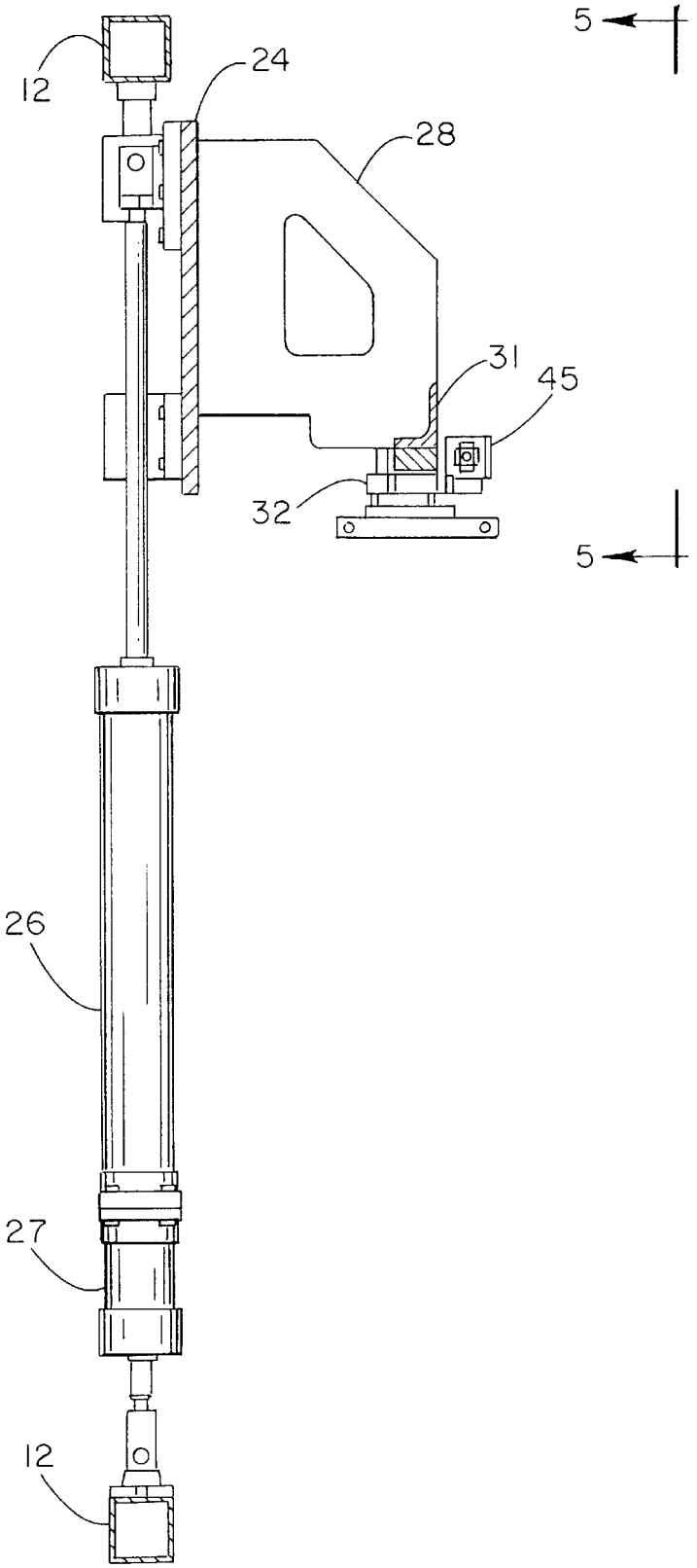
FIG. 4 shows a view along lines 4—4 of FIG. 3.
Figure 5:
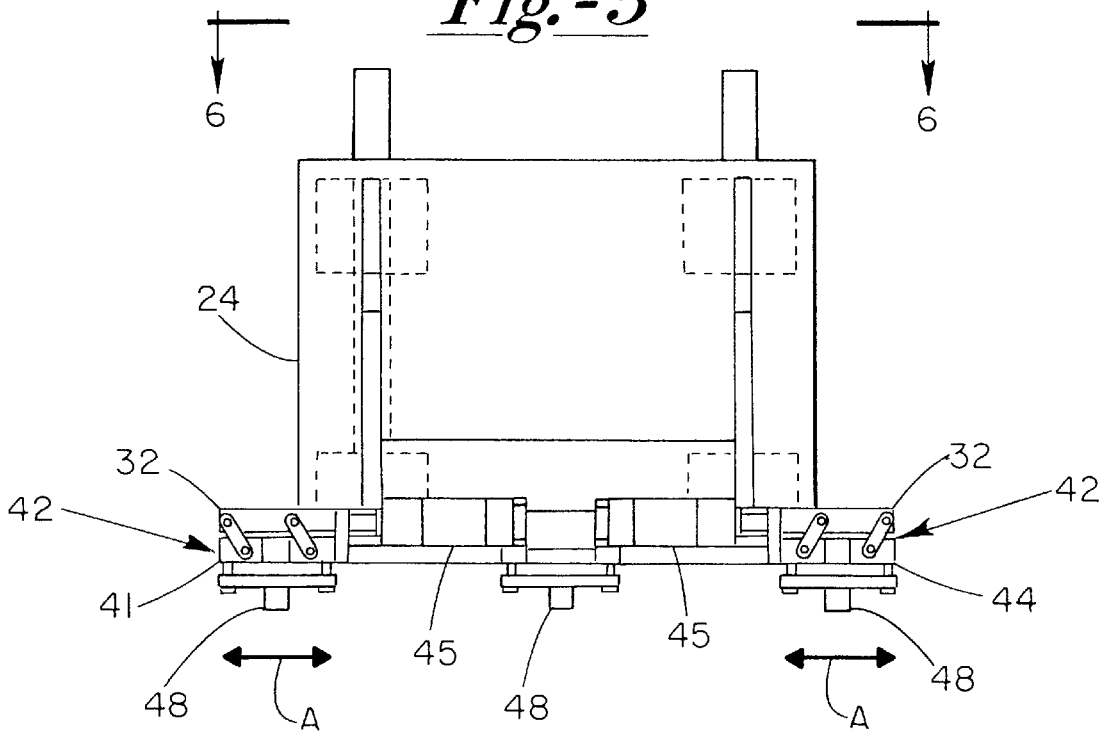
FIG. 5 shows a view along lines 5—5 of FIG. 4.
Figure 6:
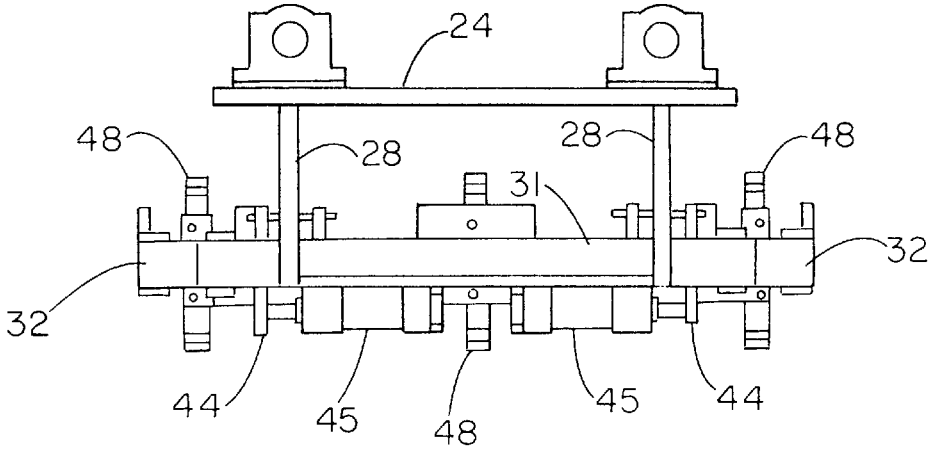
FIG. 6 shows a view along lines 6—6 of FIG. 5.
Figure 7:
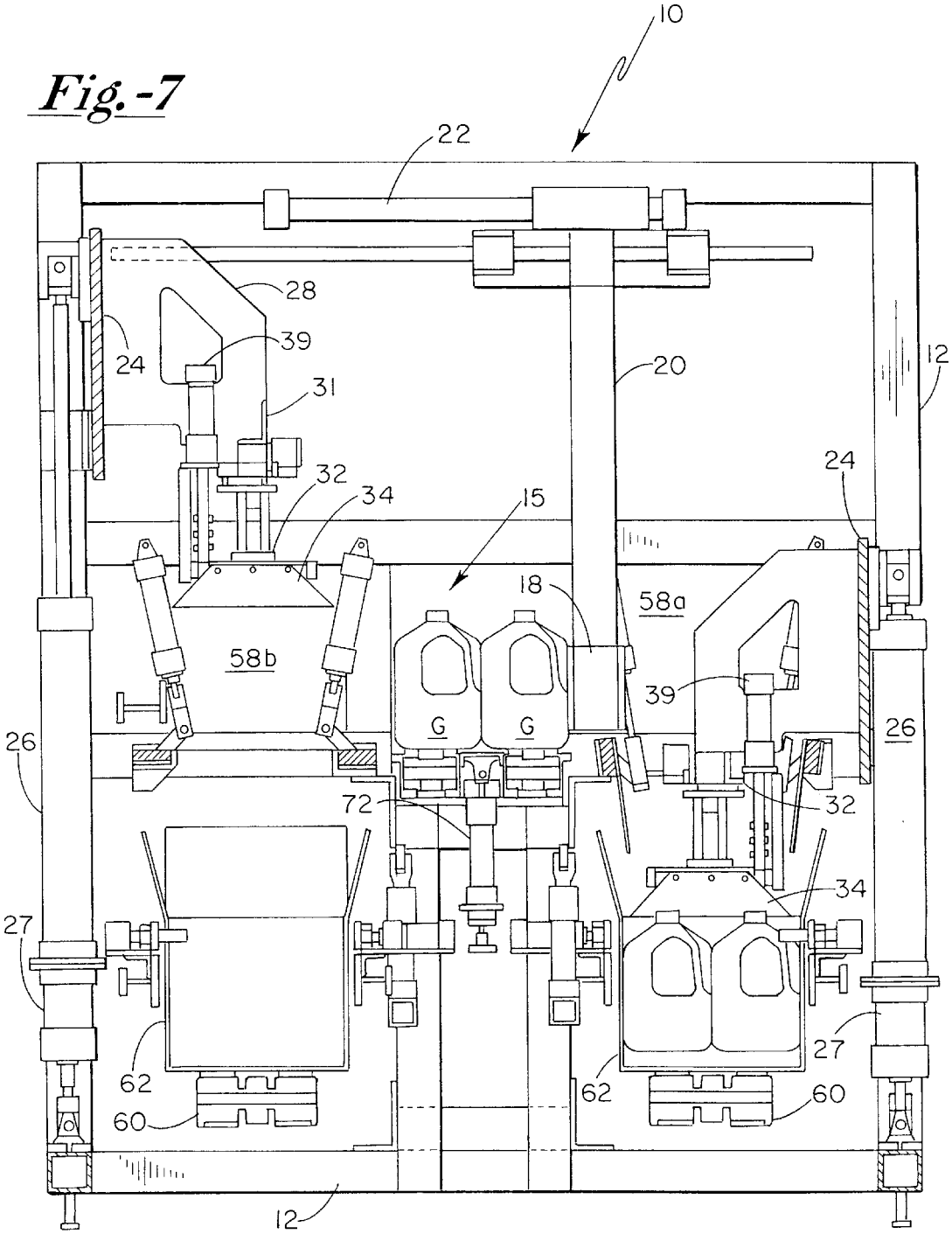
FIG. 7 shows a cross-sectional end plan view along lines 7—7 of FIG. 1.

The case loader of the present invention is seen in the various Figures and generally indicated by the numeral 10. Loader 10 includes a frame structure 12 and two in-feed conveyors 14*a* and 14*b* for delivering single file lines of containers to a pattern fonning area 15. Conveyor 14*a* and 14*b* can be of the segmented continuous link type or of the powered roller type. Clamps 16*a* and 16*b*, along with sensors and a control means, not shown, serve to regulate entry of the objects, such as one gallon milk containers G, into area 15. A pressure relief end stop 17 is extendible and retractable and serves to separate the group of objects in area 15 from the remainder of the objects upstream therefrom. This pressure relief is accomplished by a retraction of stop 17 after a suitable number of objects have entered area 15 and clamps 16*a* and 16*b* have stopped further progression of objects therein.

A pusher plate 18 is secured to a vertical member 20 which in turn is operated by a horizontal cylinder 22 secured to an upper portion of frame 12. Cylinder 22 operates to moves plate 18 horizontally between a left position indicated by the dashed line marked L and a right position indicated by the dashed line marked R. Carrier plates 24 extend vertically and are secured to and operated by vertical cylinders 26 and 27. Cylinders 26 and 27 are secured together and provide for a long and a short stroke respectively. Two plates 28 extend transversely from each carrier 24 an angle cross member 31 is secured to and extends there between. Lower horizontal cross members 32 extend between and are bolted to angle 31. Three gripper heads 34, 36 and 38 are secured to each cross member 32. Heads 34 and 38 are actually not directly secured to cross member 32, as is center cylinder 36, but are secured to lower plates 41 of parallelogram hinge assemblies 42. Assemblies 42 are secured to cross member 32 and plates 41 thereof are connected to operating arms 44 of spreading cylinders 45, which cylinders 45 are also secured to cross members 32. Spreader cylinders 45 serve to move outer gripper heads 34 and 38 horizontally between extended and retracted positions in the directions as indicated by arrow A.

Gripper heads are well known in the art and are designed to grip variously shaped objects, such as gallon containers G, half-gallon containers HG and quart containers Q. Heads 34, 36 and 38 each include cylinders 39 that serve to operate the gripping mechanisms thereof. A further gripper head 46 is shown and configured to grip containers HG and includes a gripper actuating cylinder 47. Caser 10 includes mounts 48 to which a variety of such gripper heads can be mounted to. In addition, as will be understood by those of skill, each head includes head reject sensors, not shown, for sensing an obstruction when the head travels downward by operation of either cylinders 26 or 27. In the present invention, since more two or more heads are supported together on the same cross member and operate simultaneously, it is important that each head be able to sense the presence of an obstruction so that the direction of cylinders 26 or 27 can be quickly reversed to minimize any pressure on the apparatus or the obstruction.

Caser 10 also includes trap doors 50*a* and 50*b* hingedly secured thereto and operated by cylinder pairs 52*a* and 52*b*. Pattern guides 54*a* and 54*b* are powered by cylinder 56 and serve to guide the pattern of objects formed in area 15 when moved therefrom by the motion of pusher plate 18 into loading areas 58*a* and 58*b*. A pair of conveyors 60*a* and 60*b* serve to transport cases 62 there along in the direction of arrows C and include stop mechanisms 64 connected to the control means and various other sensing mechanisms, not shown. Conveyors serve to deliver predetermined numbers of cases directly below loading areas 58 and trap doors 50*a* and 50*b*. Those of skill will appreciate that conveyors 60 can be designed to deliver cases in the direction opposite to that of arrow C. In such a situation the position of stop 64 would have to moved accordingly.

The operation of loader 10 can first be understood in the context of the loading of gallon sized containers G. Containers G are delivered along conveyors 14*a* and 14*b* into pattern forming area 15. When a desired number of containers G, in this case 12, have entered therein, clamps 16*a* and 16*b* are activated to extend and move against firther containers G upstream of area 15 stopping any further progression thereof into area 15. It can be understood that three patterns of four containers each are automatically formed by the use of the two in-feed conveyors 14*a* and 14*b* and the selected size of area 15. Stop plate 18, having been previously extended, is now retracted further separating the three patterns of containers from the containers upstream thereof and also relieving any pressure thereon due to the actions of conveyors 14*a* and 14*b*. As seen in FIG. 1, plate 18 is positioned to move against containers G and move them into area 58*a*. Guides 54*a* and 54*b* are extended at both ends of area 58*a* and serve to assist in the orderly movement of containers G into area 58*a*. Cylinder 27 extends to move plate 24, hence all heads 34, 36 and 38 downward a first short distance simultaneously so that the heads contact the tops of containers G. Cylinders 39 on each head 34, 36 and 38 then operate the gripping mechanisms thereof to grab the tops of containers G. It will be understood by those of skill that in the case of plastic containers, such as containers G, the first lowering step by the operation of cylinder 27 can be eliminated as a discreet action. In other words, heads 34, 36 and 38 can be in their first lowered position as containers G move into area 15. In the case of paper containers, as seen with containers HG, the heads 46 must be lowered thereon after patterns thereof have been formed in area 15. Guides 54*a* and 54*b* are retracted so that spreading cylinders 45 can extend which results in plates 41 extending in the directions of arrows S and carrying heads 34 and 38 therewith. Trap doors 50*a* are then operated to open by action of cylinders 52*a* and 52*b*. Previously, conveyor 60*a* has delivered three cases 62 directly below trap doors 50*a*. Cylinder 26 can now be operated to lower all 12 containers a second longer distance into three cases 62. It will be appreciated by those of skill that spreader cylinders 45 are needed to move each of the end patterns of containers outward so that they are directly centered over their intended case targets. Thus, spreader cylinders 45 provide a means for accounting for the width of the sidewalls of cases 62 so that each pattern moves directly therein without contact such sidewalls.

It will also be understood by those of skill that the same process as above described is used to place containers in loading area 58*b* and fill cases 62 in position on conveyor 60*b*. In particular, after pusher plate 18 has moved over to position moving containers G into area 58*a* it is then permissible to move further containers into loading area 15 by release of clamps 16*a* and 16*b*. In addition, plate 18 is then automatically in position to move in the opposite direction and push containers into area 58*b*. Thus, caser 10 provides for a time saving overlap of functions, wherein, as soon as containers G have been moved into area 58*a*, further containers can be moved into area 15 to be pushed into area 58*b* as the previously arranged patterns are being loaded into cases 62 from area 58*a*.

It can be appreciated that caser 10 is designed to handle differently sized objects. As seen in FIGS. 10–18, the handling and casing of gallons G, half gallons HG and quarts Q is seen, respectively. In the case of half gallon and quart containers infeed dividers 66 and 68 are utilized to direct and guide the containers and provide a rigid means against which clamps 16*a* and 16*b* can operate. In the case of gallons a plate 69 is used. A pattern forming area divider located in area 15 is also used in both the half gallon and quart cases wherein a divider 70 is used. Dividers 66, 68 and 69 are interchangeable to allow for converting caser 10 to run differently sized containers. A cylinder 72 moves divider 70 to extended positions for separating the respective half gallon or quart containers and to retracted positions below such containers if not needed, as in the case of gallon containers, and to allow for the movement of containers by pusher plate 18 into areas 58*a* and 58*b* after the patterns has been formed.

Figure 8:
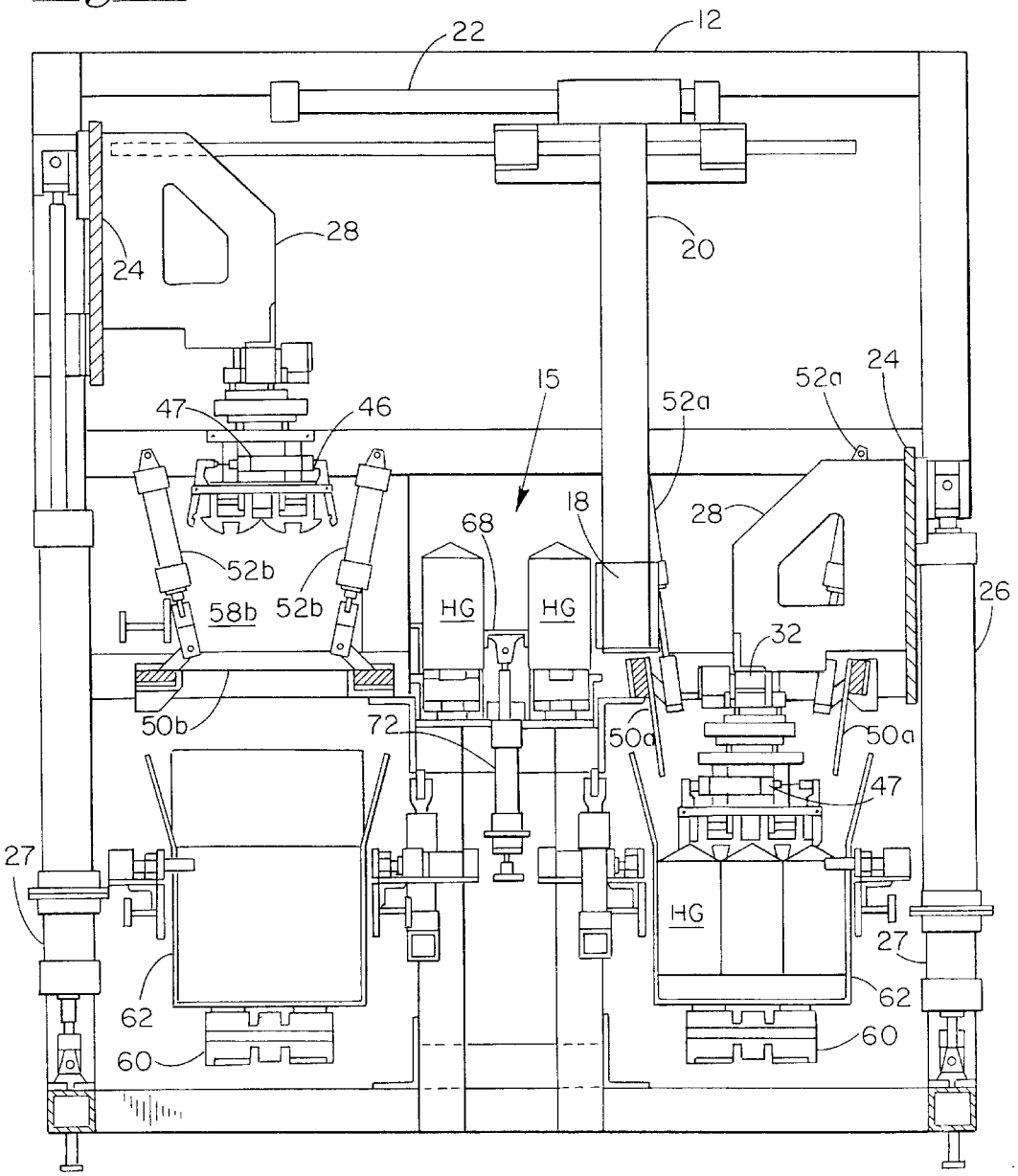
FIG. 8 shows a view equivalent to that of FIG. 7 regarding the loading of differently sized containers.
Figure 9:
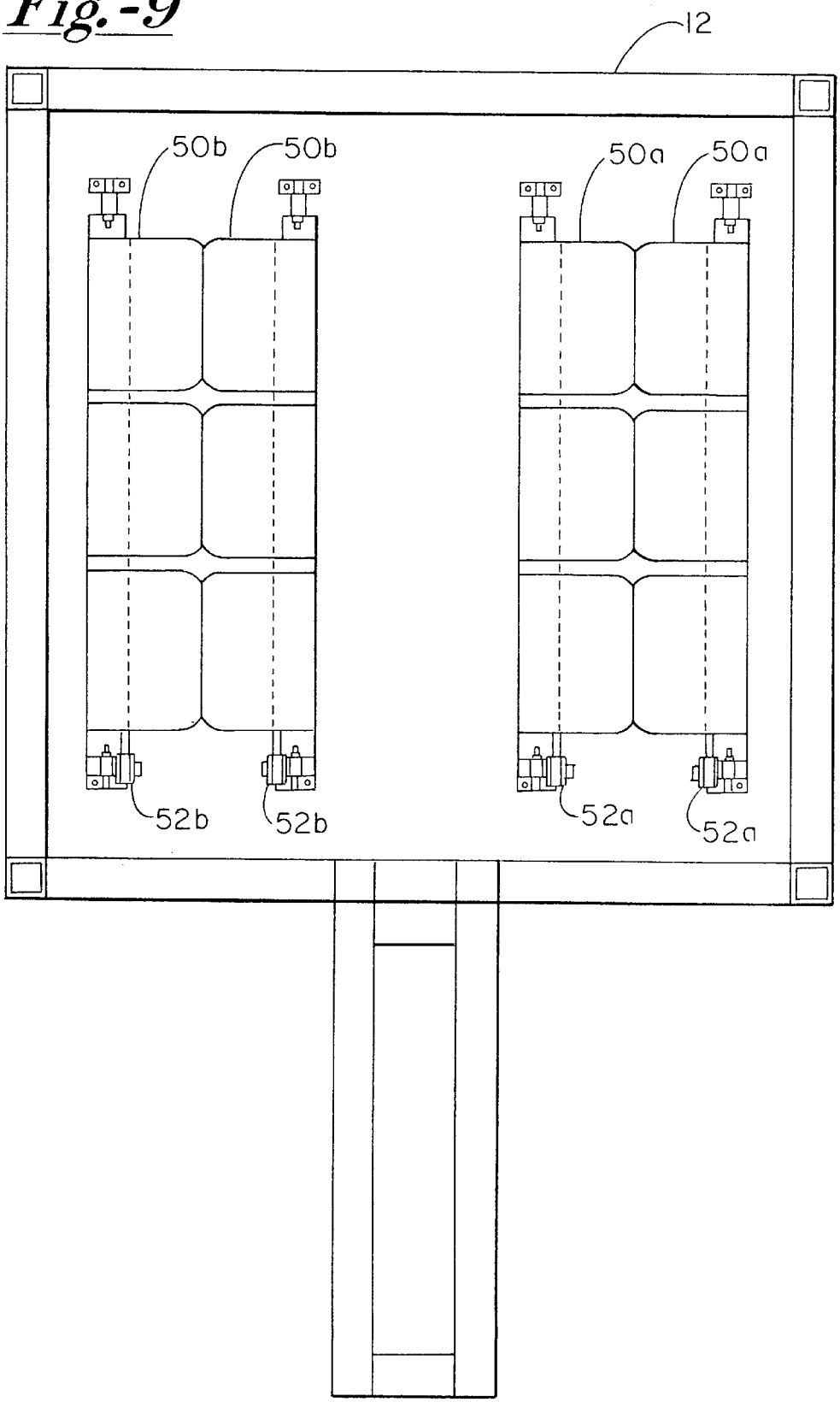
FIG. 9 shows a cross-sectional top plan view along lines 9—9 of FIG. 7.
Figure 10:
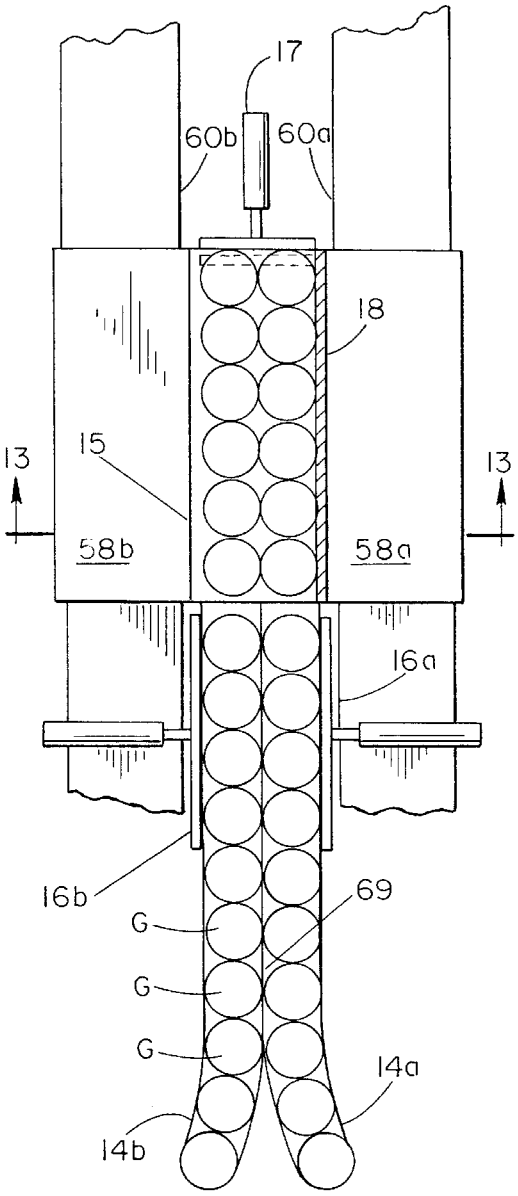
FIG. 10 shows a schematic top plan view of the present invention configured to load gallon sized containers.
Figure 11:
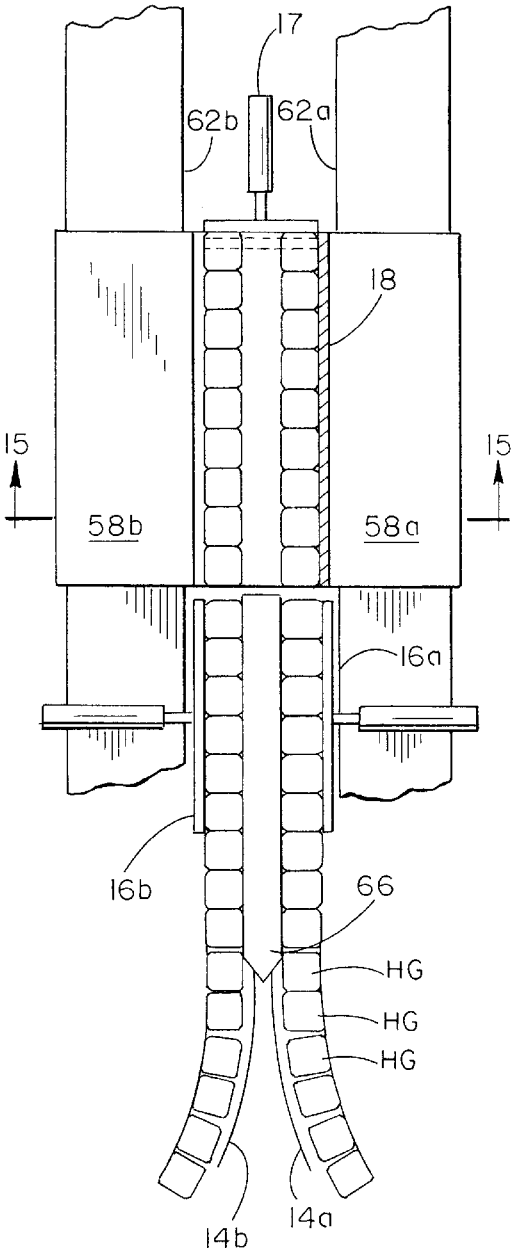
FIG. 11 shows a schematic top plan view of the present invention configured to load half-gallon sized containers.
Figure 12:
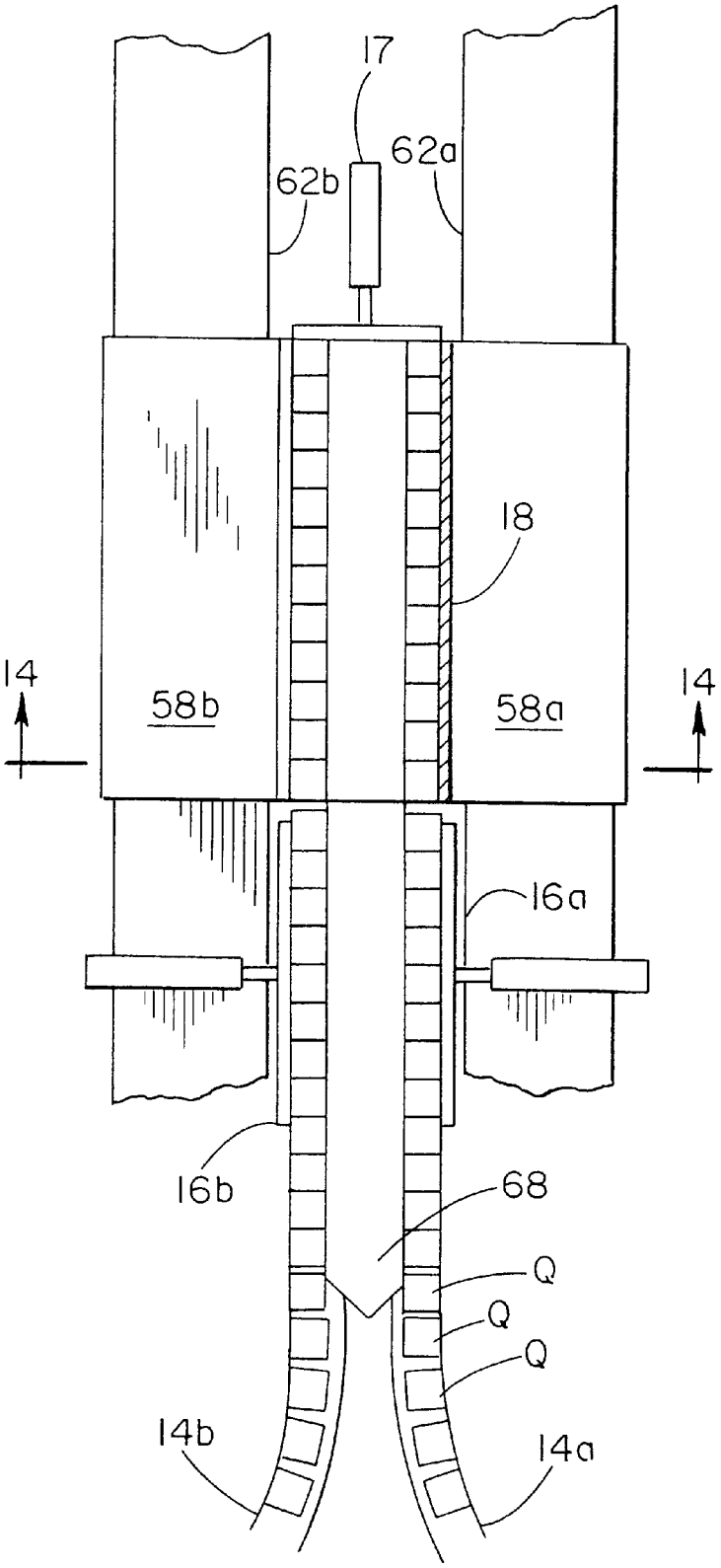
FIG. 12 shows a schematic top plan view of the present invention configured to load quart sized containers.
Figure 13:
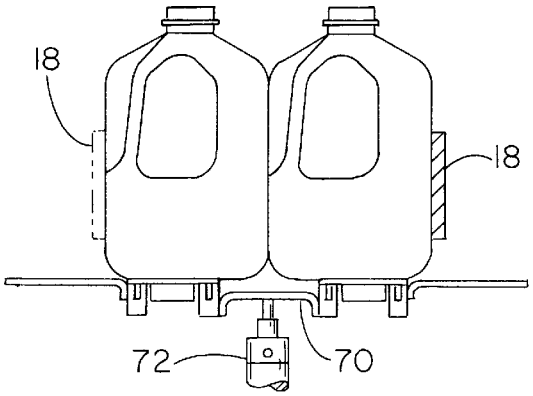
FIG. 13 shows a schematic cross-sectional view along lines 13–13 of FIG. 10.
Figure 14:
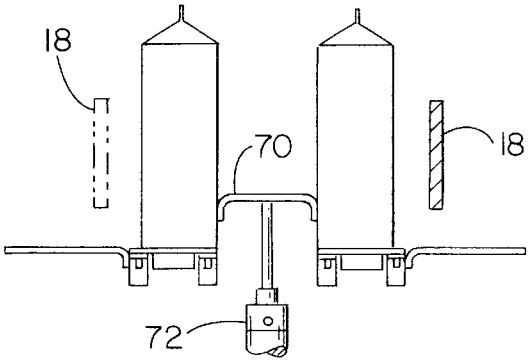
FIG. 14 shows a schematic cross-sectional view along lines 14—14 of FIG. 12.
Figure 15:
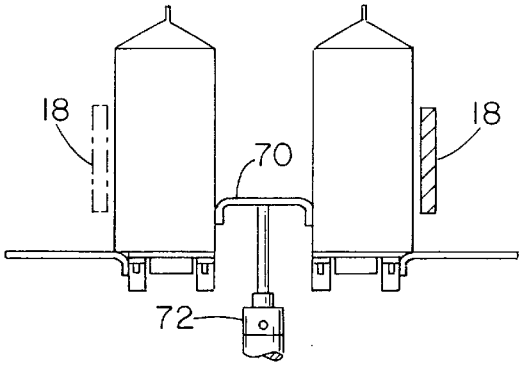
FIG. 15 shows a schematic cross-sectional view along lines 15—15 of FIG. 11.
Figure 16:
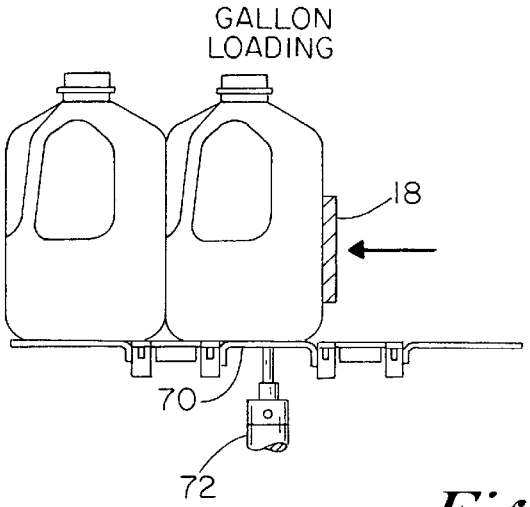
FIG. 16 shows a schematic cross-sectional view equivalent to that of FIG. 13.
Figure 17:
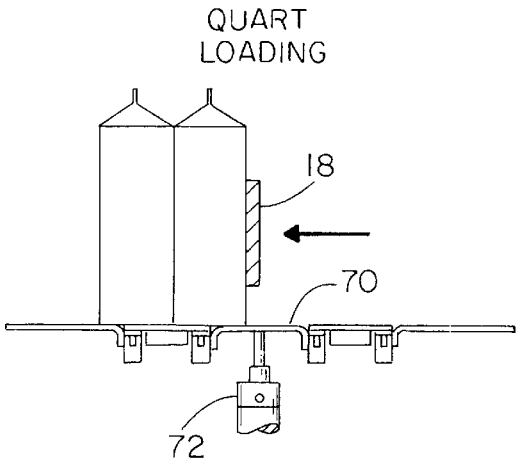
FIG. 17 shows a schematic cross-sectional view equivalent to that of FIG. 14.
Figure 18:
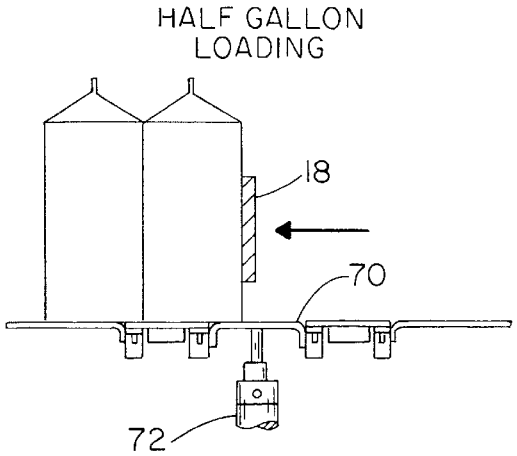
FIG. 18 shows a schematic cross-sectional view equivalent to that of FIG. 15.

In the case of half gallons a third row is needed to form a 3×3 pattern of 9 containers, as can be better understood by referring to FIG. 8. Thus, as containers HG are narrower than the containers G and a third row is needed to evenly fill cases 62, the above discussed casing procedure is modified whereby plate 18 is returned to its opposite position after moving two rows into, for example, area 58*a*. Clamp 16*a* is then released to deliver only one row into area 15. Plate 18 is then operated to move the single row into area 58*a* against the two rows previously pushed therein. The remainder of the sequence is the same as above described for loading cases 62. Of course, the equivalent process is used to load three rows into area 58*b*. Those of skill will also appreciate that the placement of still smaller quart containers requiring 4×4 patterns of 16 containers to form the width of a full pattern in either areas 58*a* or 58*b* would use the modified process as above described, except where two rows would be allowed to enter area 15 twice in order to fill each area 58*a* and 58*b*. Naturally various gripper heads would be needed to accommodate the variously sized containers.

As previously stated a control means is used herein. Such control means can be a programmable logic controller or the equivalent, and is used to control the sequence of operation of the various cylinders used in caser 10 based upon sensing inputs thereto. Such sensors include a variety of mechanical, electronic and photo position and proximity sensors for sensing the positions of the various containers, clamps, pushers and cases. Such sensing is well known in the art as well as is the manner in which such sensing information is used to control the basic operation of various components of caser 10. Furthermore, the present invention uses a plurality of pneumatic valves, pressurized lines and so forth for operating of the various cylinders herein. All such basic sensing, controlling and pneumatic hardware and its construction, operation and manner of use are well known in the art. Therefore the description thereof is not included herein in order to facilitate a clear understanding and explanation of the operation and advantages of the present invention. It will further be appreciated that various other containers or objects other than strictly dairy related products could be loaded into cases using the structure and method herein described. It will also be appreciated that various numbers of cases could be loaded simultaneously with adjustments of scale of the present invention. Thus, further gripper heads would be required as would further spreader cylinders if more than three gripper heads are utilized. If an odd number of gripper heads are used then the center head could be left stationary and the reaming heads spread away therefrom as required to center above the cases.

We claim:

1. A case loader, comprising:

a pair of substantially parallel and adjacent in-feed conveyors for moving a plurality of pairs of objects to first positions within a pattern forming area, and the in-feed conveyors having a mechanism for regulating the movement of a predetermined number of objects into the pattern forming area, a reciprocal pusher for moving the predetermined number of objects formed in the pattern forming area into alternate loading areas located on either side of the pattern forming area, each loading area having a trap door operable between a closed position and an open position and each loading area having vertically translatable gripper, a pair of case in-feed conveyors for the regulated delivering of a plurality of cases directly below each trap door so that when a pattern is moved into a loading area the trap door thereof is in the closed position for supporting the pattern thereon and the respective gripper movable downward to contact and grip the pattern of objects so that when the trap door thereof is operated to the open position the pattern of objects are held by the respective gripper and further vertically translatable downward into cases on the respective case in-feed conveyor for loading therein.

2. The case loader as defined in claim 1 and differently sized separator plates removably securable upstream of the pattern forming area between the object in-feed conveyors.

3. The case loader as defined in claim 1, and the mechanism for moving a predetermined number of objects into the pattern forming area providing for moving object therein along one object in-feed conveyor at a time.

4. The case loader as defined in claim 1, and a vertically translatable divider mechanism located between the object in-feed conveyors within the pattern forming area and having a divider plate and extendable between a top and bottom position.

5. The case loader as defined in claim 4 and differently sized separator plates removably securable upstream of the pattern forming area between the object in-feed conveyors.

6. The case loader as defined in claim 5, and the mechanism for moving a predetermined number of objects into the pattern forming area providing for moving object therein along one object in-feed conveyor at a time.

* * * * *